United States Patent [19]

Uchiya

[11] 3,936,788

[45] Feb. 3, 1976

[54] THERMOBIMETAL-CARRYING ELASTIC MEMBER AND TEMPERATURE-CONTROL CIRCUIT COMPONENT USING THE MEMBER AS SENSING ELEMENT

[75] Inventor: Tomoyoshi Uchiya, Misato, Japan

[73] Assignee: Uchiya Co., Ltd., Tokyo, Japan

[22] Filed: Sept. 19, 1974

[21] Appl. No.: 507,360

[30] Foreign Application Priority Data

Nov. 6, 1973 Japan ..... 48-124728

[52] U.S. Cl. ..... 337/372; 337/343

[51] Int. Cl.² ..... H01H 37/52

[58] Field of Search ..... 337/372, 365, 343, 53, 337/133, 131

[56] References Cited

UNITED STATES PATENTS 2,861,151 11/1958 Moore ..... 337/343

3,131,270 4/1964 Kurz ..... 337/53

*Primary Examiner*—Harold Broome

*Attorney, Agent, or Firm*—George B. Oujevolk

[57] ABSTRACT

A thermobimetal-carrying elastic member of electrically conductive material springingly deformable by the action of the bimetal that recurves on temperature change, and a temperature-control circuit component, such as a thermostat, which uses the elastic member as its sensing element. The elastic member has catches for loosely supporting the recurving bimetal at the both ends, so that the member portion between the catches can follow the recurving motion of the bimetal, undergoing similar springing deformation. This construction enables the overall temperature characteristic of the sensing element or the component to depend generally upon that of the bimetal alone.

4 Claims, 6 Drawing Figures

THERMOBIMETAL-CARRYING ELASTIC MEMBER AND TEMPERATURE-CONTROL CIRCUIT COMPONENT USING THE MEMBER AS SENSING ELEMENT

BACKGROUND OF THE INVENTION

This invention relates to an improved thermobimetal-carrying an elastic member and a temperature-control circuit component, such as a thermostat, using the elastic member as the sensing element.

In temperature control devices, a thermobimetal, made of two dissimilar metals with different thermal expansion coefficients bonded together so that there is a deformation with temperature is essential as a sensing element for the manufacture, for example, of a thermostat. Bimetals of this character have commonly involved the following difficulties:

1. Extra work of fixedly mounting the bimetal on the elastic backing is required.
2. Because the bimetal is solidly combined with the backing, the temperature characteristic of the combination differs considerably from that of the bimetal alone. This makes precise temperature setting of the combination very difficult.
3. The process of fabrication is complicate.

SUMMARY OF THE INVENTION

It is an object of the present invention to provide a thermobimetal-carrying elastic member which overcomes all of the foregoing difficulties.

Another object of the invention is to provide an improved thermobimetal-carrying elastic member comprising a bimetal so formed as to recurve springingly on a temperature change beyond a certain limit, and an electrically conductive elastic member having catches for loosely holding the both ends of the bimetal, the two constituents being so combined that the recurving of the bimetal pushes the portion of the elastic member between its catches and thereby deforms the elastic member, too, in a springing manner.

Yet another object of the invention is to provide an improved temperature-control circuit component, such as a thermostat, which, when switched on, permits most of the operating current to flow through the elastic member as a sensing element and thereby maintain the temperature characteristic of the recurving bimetal unaffected.

The thermobimetal-carrying elastic member and the thermostat using the member as the sensing element, both of which are provided in accordance with this invention, have stabilized temperature characteristics because the bimetal is loosely held by the elastic member instead of being directly supported by the thermostat as in the conventional arrangement, enabling the overall temperature characteristic to depend almost solely upon that of the bimetal.

Moreover, the fabrication and temperature setting of the elastic member and thermostat or the like according to the invention are extremely easy with their temperature characteristics uninfluenced by the fabrication work.

BRIEF DESCRIPTION OF THE DRAWING

The above and other objects, advantages and features of the present invention will be more fully understood from the following description taken in connection with the accompanying drawings, in which.

It should be understood that the spacing among the bimetal, catches, and elastic member is exaggerated to indicate the relative positions of the parts distinctly and that, in reality, the parts may be disposed more closely to one another without departing from the spirit of the invention.

DETAILED DESCRIPTION OF THE PREFERRED EMBODIMENT

Figure 1:
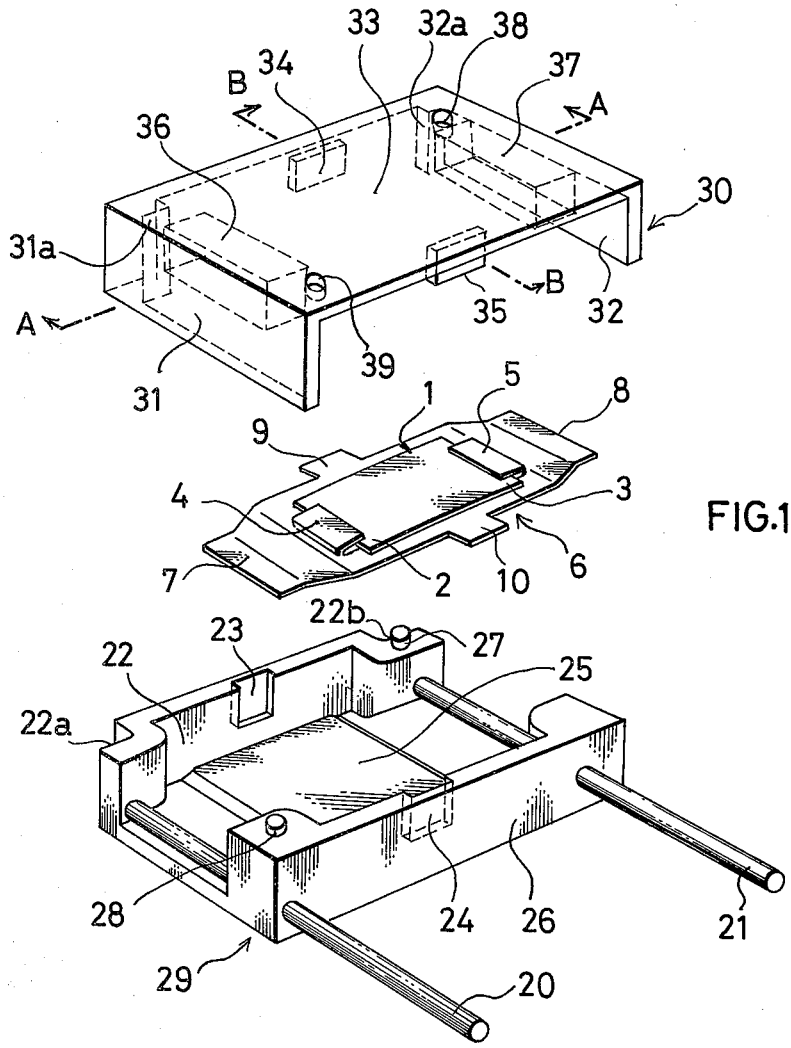
FIG. 1 is an exploded view, on an enlarged scale, of a temperature-control circuit component, such as a thermostat, using a thermobimetal-carrying elastic member as the sensing element in accordance with the present invention.

Referring now to FIG. 1, there is shown a bimetal 1 of the recurving type held at both ends 2, 3 by catches 4, 5 on an electrically conductive elastic member 6.

Figure 4:
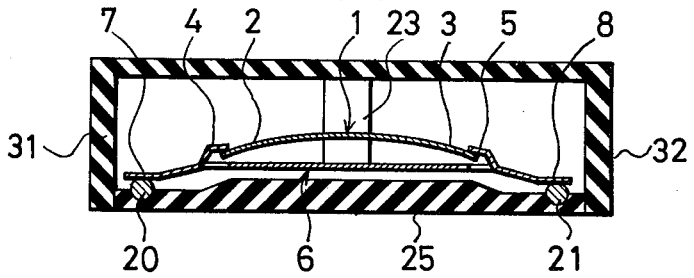
FIGS. 4 to 6 are sectional views taken on line C—C of FIG. 3, and explanatory of the operation of the thermobimetal-carrying elastic member and the temperature-control circuit component using the elastic member in conformity with the invention.

The recurving bimetal 1 may be of a known construction but is plastically deformed beforehand to curve on one side, so that it recurves springingly on a temperature change beyond a certain limit. The turning point may be set as desired in consideration of the shape and size of the bimetal and the degree of its plastic deformation to be given in advance. While the bimetal shown in the drawings is rectangular, it may be shaped otherwise, for example to a circle. In low-temperature condition the bimetal retains its original curve as shown in FIG. 4. At elevated temperature it curves back and bends downwardly.

The catches 4, 5 of the conductive elastic member 6 engage the both ends 2, 3 of the recurving bimetal 1 to hold it loosely. These catches are integrally secured to the backing member by some suitable means. Alternatively, they may be formed like louvers by lancing when the member is punched out. The elastic member has sufficient size to carry the bimetal and is shaped as a rectangular plate, for example. It catches 4, 5 have only to serve as means to keep the both ends of the bimetal from slipping off from the elastic member and to support the bimetal movably. For this reason, they may be shaped like hooks or fins as shown to catch the bimetal. The elastic member is made of a material that possesses both electrical conductivity and elasticity. For example, it may be phosphor bronze plate. The bimetal and the elastic member are so connected that, while recurving on a temperature change, the bimetal pushes the catches apart and thereby cause the backing to recurve in a springing manner.

Figure 5:
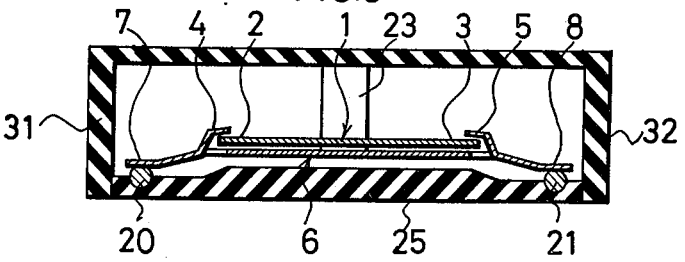
Figure 6:
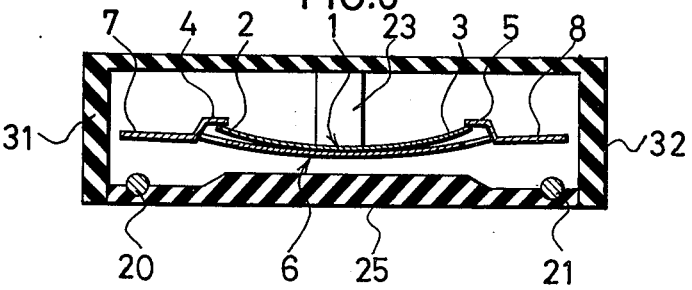

FIGS. 4 to 6 illustrate the principle of this sudden recurving motion of the elastic member.

As the temperature of the unit shown in FIG. 4 increases, the curvature of the recurving bimetal 1 decreases gradually to almost zero, on the average, as in FIG. 5. A further rise of the temperature causes the bimetal to recurve suddenly to the state shown in FIG.

6. During the recurving the bimetal presses and deforms the elastic member 6 by the catches 4, 5. The relative positions of the bimetal and the elastic member are such that the deformation of the bimetal from the state in FIG. 4 to the neutral posture in FIG. 5 is little restrained by the member. Immediately beyond the neutral point the bimetal springingly deforms the backing, too, as in FIG. 6.

With the construction and principle described, the invention presents the following advantages. First, in the course of fabrication, the usual procedure of fixing the bimetal to the elastic backing can be omitted. While the temperature characteristic for recurving of the bimetal depends on the bimetal's deformation up to the neutral point, the characteristic remains unaffected even after the bimetal has been combined with the elastic member. Therefore, the deformative temperature characteristic of the bimetal-carrying elastic member can be simply known from that of the bimetal alone. This greatly facilitates the control of the overall temperature characteristic and simplifies the fabrication of the thermobimetal-carrying elastic member.

The member thus made in accordance with the present invention has wide application as a sensing element for thermostats.

Figure 2:
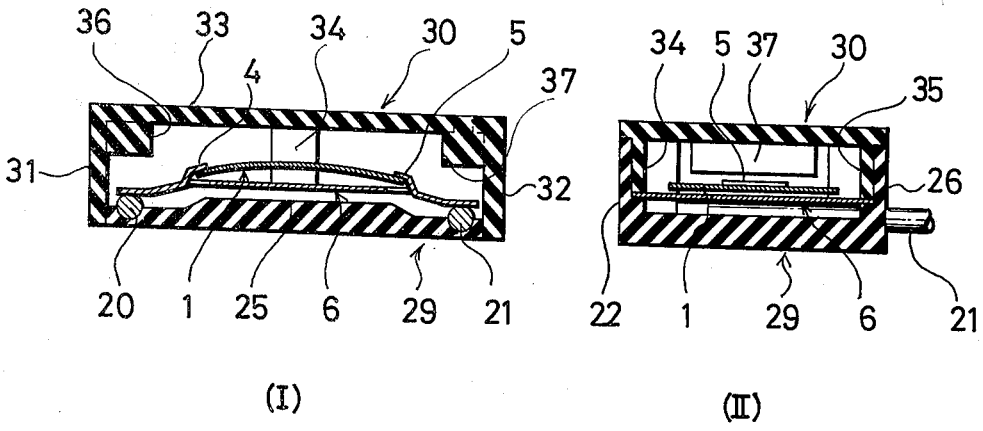
FIGS. 2(I) and (II) are sectional views taken on lines A—A and B—B, respectively, of FIG. 1, with the thermostat or the like assembled.
Figure 3:
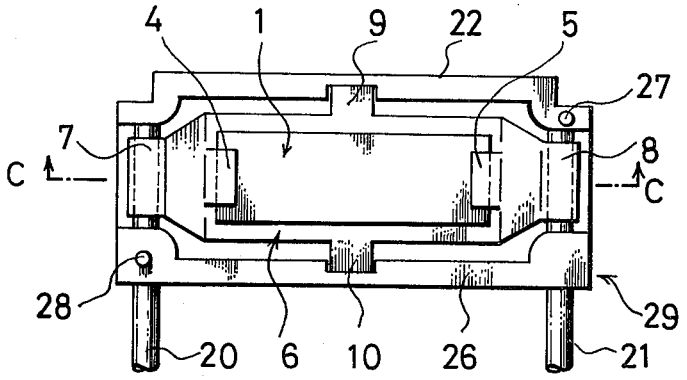
FIG. 3 is an enlarged plan view of the temperature-control circuit component embodying the invention, with the cover removed.

Referrring back to FIGS. 1 to 3, the elastic member 6 is shown as having two end flaps 7, 8 extending from the catches 4, 5, respectively, and two lugs 9, 10 formed at the middle points of the both edges. The thermobimetal-carrying elastic member fabricated in the manner described is contained in a casing consisting of a case body and a cover 29, 30, as shown in FIGS. 2(I) and (II).

The case body 29 is made up of side walls 22, 26 and a bottom 25, both of an electrically insulating material. The both ends of the bottom 25 support electric contact bars 20, 21 which extend in parallel, for example, from the side wall 26 to the outside so that the exposed bar portions serve as terminals. The lugs 9, 10 of the elastic member 6 are supported by recesses 23, 24 formed in the inner middle parts of the side walls 22, 26 and, as shown in FIG. 2(I), the both end flaps 7, 8 of the elastic member are kept in contact with the contact bars 20, 21. Rodlike upward projections 27, 28 are formed, respectively, on the side walls 22, 26, diagonally on their upper corners.

The cover 30 is composed of side walls 31, 32 having a width corresponding to the distance between the side walls 22, 26 of the case body, and a top 33 covering the case body. The cover is made of an insulating material and, like the case body, it is formed, for example, by molding in one piece. On the underside of the top 33 are formed two rectangular-shaped downward projections 34, 35 adapted to fit in the recesses 23, 24 of the case body 29. These projections and recesses coact, as shown in FIG. 2(II), to grip the lugs 9, 10 and hold the elastic member 6 in place. Internal corner blocks 36, 37 are formed inwardly of the corners between the top 33 and the side walls 31, 32 of the corver, in such a way that, when the case body 29 and the cover 30 are assembled as in FIG. 2(I), the corner blocks 36, 37 come over the end flaps 7, 8 of the elastic member 6. Also, the cover is formed with holes 38, 39 to receive the upward projections 27, 28 of the case body.

When the case body 29 containing the elastic member 6 has been enclosed by the cover 30 in the manner described, the recesses 23, 24 are engaged with the downward projections 34, 35 to grip the lugs 9, 10 of the elastic member, while the upward projections 27, 28 fit in the holes 38, 39 and, in addition, external corner recesses **22*a*, 22*b* formed at the outer corners of the side wall 22 of the case body receive corresponding corner extensions 31*a*, 32*a*** of the cover. In this way the case body and the cover are accurately positioned, simply assembled, and joined together with suitable means such as adhesive.

The operation of the above-described thermostat or suchlike component of a temperature-control circuit will now be explained. As shown in FIG. 6, the deformation of the elastic member brings its end flaps 7, 8 out of contact with the contact bars 20, 21. In other words, the electric continuity established between the contact bars in FIG. 4 is broken in FIG. 6. In this connection the arrangement according to the invention can control an electric circuit on the basis of temperature changes. The majority of the operating current flows through the elastic member, and therefore the temperature characteristic of the bimetal 1 is little affected by the bypassing current. It is possible to support the elastic member by the end flaps 7, 8 rather than by the lugs 9, 10 and to have the electric contact made by the latter instead. As a further alternative, the elastic member may be supported only at one point, say by the end flap 7, and the movement of some other part, say the end flaps 8, may be taken advantage of to achieve the electric switching action. In the deformation of the elastic member the deformative motion can be intensified by utilizing the lengths of the end flaps 7, 8.

Since the bimetal of the recurving type is mounted on the elastic member in accordance with the invention, the combination ensures great stability in the positional relationship of the parts determinative of the temperature characteristic. There is no possibility of the temperature characteristic deviating from the present range during the subsequent assembling of the elastic member with other parts. With the ordinary sensing element of the unmounted type, by contrast, the recurving bimetal and the elastic member must be held in relative positions by another member, such as a casing, and the element's temperature characteristic is easily affected by the thermal deformation of the casing and other factors. Thus, the conventional sensing element involves much difficulties in temperature setting and in assembling.

As has been described hereinabove, the present invention presents a great industrial advantage by realizing a thermobimetal-carrying elastic member that eliminates the shortcomings of the prior art elements of the kind.

While the preferred form of the present invention has been described, it is to be understood that the invention is not limited thereto but may be otherwise variously embodied without departing from the spirit or scope of the following claims.

What is claimed is:

1. A temperature-control circuit component, such as a thermostat, having a thermobimetal-carrying elastic member composed of a bimetal that will recurve or rebound in a springing manner with a temperature change beyond a preset limit and an electrically conductive elastic member having catches for loosely holding the bimetal at both ends, said bimetal being adapted to permit, in the course of its recurving, spring deformation of the elastic member, too, said elastic member being formed with lugs for support on both sides, and a pair of electric contact members adapted to perform electric switching action in cooperation with the elastic member, said electric switching action with temperature changes depending upon the springing deformation of the elastic member with the recurving of the bimetal, the improvement therein comprising a case body having electric contacts at both ends and containing the elastic member, a cover for the case body, and means provided between the case body and the cover to support the lugs of the elastic member in place.

2. A component according to claim 1, wherein the lug-supporting means consists of recesses formed in the both side walls of the case body to receive the lugs, and projections formed on the underside of the cover so that, when the cover and the case body are assembled together, the projections fit in the recesses to grip the lugs therebetween.

3. A temperature-control circuit component such as a thermostat, which comprises a recurving bimetal adapted to do a springingly recurving action due to a change in temperature, an electrically conductive elastic member having catch portions for loosely holding both ends of said bimetal, support lug portions so formed at both sides of said elastic member as to enable a springing deformation of said elastic member to be accomplished, electric contacts adapted to make an electrically open and close action by cooperation with said elastic member, a lower casing having said electric contacts at both ends and housing said elastic member, an upper casing to cover said lower casing and means for supporting said support lug portions provided in said upper and lower casings, wherein an electrically open-and close action due to a temperature change for said electric contacts being adapted to rely on a springing deformation of said elastic member about said support lug portions as a support point due to the recurving action of said bimetal.

4. A component according to claim 3, wherein the lug-supporting means consists of recesses formed in both side walls of the lower casings to receive the lug portions, and projections formed on the underside of the cover so that, when the cover and the upper casings are assembled together, the projections fit in the recesses to grip the lug portions therebetween.

* * * * *